US007878157B2

(12) United States Patent
Effert et al.

(10) Patent No.: US 7,878,157 B2
(45) Date of Patent: Feb. 1, 2011

(54) FOSSIL-FUEL HEATED CONTINUOUS STEAM GENERATOR

(75) Inventors: Martin Effert, Erlangen (DE); Joachim Franke, Altdorf (DE); Rudolf Kral, Stulln (DE)

(73) Assignee: Siemens Aktiengesellschaft, Munich (DE)

( * ) Notice: Subject to any disclaimer, the term of this patent is extended or adjusted under 35 U.S.C. 154(b) by 666 days.

(21) Appl. No.: 11/663,243

(22) PCT Filed: Jul. 22, 2005

(86) PCT No.: PCT/EP2005/053566

§ 371 (c)(1),
(2), (4) Date: Feb. 6, 2008

(87) PCT Pub. No.: WO2006/032556

PCT Pub. Date: Mar. 30, 2006

(65) Prior Publication Data

US 2008/0257282 A1 Oct. 23, 2008

(30) Foreign Application Priority Data

Sep. 23, 2004 (DE) ..... 10 2004 046 187

(51) Int. Cl.
*F22G 3/00* (2006.01)
*F22B 33/00* (2006.01)

(52) U.S. Cl. ..... 122/6 A; 122/406.1; 122/468

(58) Field of Classification Search ..... 122/1 C, 122/6 A, 406.1, 409, 467, 468, 479.2
See application file for complete search history.

(56) References Cited

U.S. PATENT DOCUMENTS 3,608,525 A 9/1971 Sharan
3,612,003 A * 10/1971 Sharan ..... 122/235.11
4,738,224 A * 4/1988 Bruckner et al. ..... 122/7 R
5,390,631 A * 2/1995 Albrecht ..... 122/235.12
5,706,766 A * 1/1998 Koehler et al. ..... 122/6 A (Continued)

FOREIGN PATENT DOCUMENTS

DE 615 355 C 7/1935

(Continued)

OTHER PUBLICATIONS

Von H. Juzi, A. Salem and W. Stocker; "Zwangdurchlaufkessel für Gleitdruckbetrieb mit vertikaler Brennkammerberohrung"; VGB Kraftwerktechnik, VGB Kraftwerktechnik GmbH; Apr. 1984; pp. 292-302; XP002054983; ISSN: 0372-5715; Essen, Germany.

*Primary Examiner*—Gregory A Wilson

(57) ABSTRACT

The invention relates to a fossil-energy heated continuous steam generator, whereby the at least one combustion chamber, viewed in the flow direction of the hot gases, is divided into at least two throughflow segments, formed by evaporator heating surfaces, whereby the evaporator heating surfaces each comprise steam generation tubes welded to each other in a gastight manner and pressurized in parallel with a flow medium. According to the invention, said generator is suitable for operation with high fresh steam parameters, such as for example, steam temperatures of approximately 700° C., with a simple construction and particularly simple assembly, whereby a throughflow segment, arranged after the first through flow segment, viewed in the direction of flow of the hot gases, forms the first evaporator stage for the flow medium, such that the injection of particularly cold flow medium can occur in the region of maximum heating.

13 Claims, 2 Drawing Sheets

U.S. PATENT DOCUMENTS

| | | | | |
|---|---|---|---|---|
| 5,735,236 | A | 4/1998 | Kastner et al. | |
| 6,189,491 | B1 * | 2/2001 | Wittchow et al. | 122/1 C |
| 6,427,637 | B1 | 8/2002 | Ineichen | |
| 6,446,580 | B2 * | 9/2002 | Franke et al. | 122/6 A |
| 6,481,386 | B2 * | 11/2002 | Wittchow | 122/6 A |
| 6,499,440 | B2 * | 12/2002 | Franke et al. | 122/459 |
| 6,715,450 | B1 * | 4/2004 | Wittchow | 122/1 B |
| 7,243,618 | B2 * | 7/2007 | Gurevich | 122/7 R |
| 2002/0157618 | A1 * | 10/2002 | Franke et al. | 122/406.4 |
| 2008/0257282 | A1 * | 10/2008 | Effert et al. | 122/1 R |

FOREIGN PATENT DOCUMENTS

| | | | |
|---|---|---|---|
| TW | 313620 | A | 8/1997 |
| TW | 413723 | B | 12/2000 |
| WO | WO 01/01040 | A1 | 1/2001 |

* cited by examiner

FOSSIL-FUEL HEATED CONTINUOUS STEAM GENERATOR

CROSS REFERENCE TO RELATED APPLICATIONS

This application is the US National Stage of International Application No. PCT/EP2005/053566, filed Jul. 22, 2005 and claims the benefit thereof. The International Application claims the benefits of German application No. 10 2004 046 187.2 filed Sep. 23, 2004, both of the applications are incorporated by reference herein in their entirety.

FIELD OF INVENTION

The invention relates to a fossil-fuel heated continuous steam generator, in which at least one combustion chamber wall of the combustion chamber, viewed in the direction of flow of the hot gas, is divided into at least two throughflow segments formed by evaporator heating surfaces, with the evaporator heating surfaces each comprising steam generator tubes that are welded together in a gas-tight manner in each instance and can each be subjected to the action of a flow medium in a parallel manner.

BACKGROUND OF THE INVENTION

In the case of a power plant with a steam generator, the hot gas generated during the combustion of a fossil fuel is used to evaporate a flow medium in the steam generator. To evaporate the flow medium, the steam generator has steam generator tubes, which are heated with hot gas to cause evaporation of the flow medium conducted therein, generally water. The steam supplied by the steam generator can for example be provided for a connected external process or to drive a steam turbine. If the steam drives a steam turbine, a generator or production machine is generally operated via the turbine shaft of the steam turbine.

A steam generator can be conceived according to a range of design principles. In a continuous steam generator the heating of a number of steam generator tubes, which together form the gas-tight enclosing wall of the combustion chamber, results in total evaporation of a flow medium in the steam generator tubes in one pass. After evaporation the flow medium is generally fed to the superheater tubes arranged after the steam generator tubes, where it is superheated.

In contrast to a natural circulation steam generator, a continuous steam generator is not subject to pressure limitation, so that it can be designed for live steam pressures far above the critical pressure of water ($p_{critical}$=221 bar). A high live steam pressure and a high live steam temperature favor a high level of thermal efficiency and therefore lower $CO_2$ emissions from a fossil-fuel heated continuous steam generator.

Generally in a continuous steam generator the side walls of the combustion chamber, viewed in the direction of flow of the hot gas, are divided into a number of throughflow segments formed by evaporator heating surfaces. The steam generator tubes, each welded together in a gas-tight manner and able to be flowed through from bottom to top, are assembled in each of the throughflow segments such that they can each be subjected to the action of a flow medium in a parallel manner. To this end an intake collector acting as a distributor is connected before each throughflow segment and an outlet collector is connected afterward. Such a configuration allows reliable pressure compensation between the steam generator tubes of a throughflow segment that are connected in a parallel manner and thus particularly favorable distribution of the flow medium as it flows through the steam generator tubes.

In the case of the continuous steam generator known for example from WO 01/01040 A1, the throughflow segments arranged in the side walls of the combustion chamber are connected in series on the flow medium side such that the flow medium flows through them in the sequence of their arrangement along the flow path provided for the hot gas inside the combustion chamber. In other words, the flow medium provided for the operation of the continuous steam generator, having as yet no steam element and being comparatively cold, is first fed to the first throughflow segment of the side wall, viewed in the direction of flow of the hot gas. The first intake collector assigned to this segment distributes the flow medium to the steam generator tubes that can be subjected to its action in a parallel manner, in which a first evaporation of the flow medium takes place. The water-steam mixture thus generated is collected in an outlet collector arranged after the first throughflow segment and fed via a line or a line system to the intake collector of the second throughflow segment, viewed in the direction of flow of the hot gas, where further heat is supplied to the flow medium and it is evaporated further. Reference is therefore made to a first and second evaporator stage, which can optionally be followed by still further evaporator stages. The outlet collector of the first evaporator stage can alternatively also be configured such that it acts as the intake collector to the second evaporator stage at the same time.

A preheater (economizer) is generally connected before the first evaporator stage on the flow medium side, utilizing the residual heat of the hot gas leaving the combustion chamber via a gas train connected afterward on the hot gas side to preheat the flow medium to be evaporated. This increases the overall efficiency of the continuous steam generator. The preheater does not however represent an evaporator stage, as the flow medium leaving it does not as yet have a steam element.

In steam states that place high demands on design, in particular at live steam temperatures of around 600° C., which are sought and also achieved for a high level of thermal efficiency, the problem of material fatigue arises. The high level of thermal loading means that comparatively large regions of the side walls enclosing the combustion chamber have to be cooled particularly efficiently. To this end, in addition to smooth tubes arranged in a spiral manner, vertically oriented steam generator tubes, also provided with internal ribs for example, can be provided, with which a particularly efficient and regular heat transfer to the flow medium conducted in them can take place due to the wetting of the internal wall of the tube with a deposited fluid film. Comparatively low wall temperatures are achieved as a result.

If still higher live steam temperatures of up to around 700° C. are sought, such tube cooling designs alone do not suffice for reliable long-term operation with the known steam generators. Instead particularly high quality and expensive materials are required in this instance during the manufacture of the steam generator tubes, said materials having to undergo a subsequent heat treatment after welding at the assembly site of the steam generator. The associated assembly cost is so high that continuous steam generators designed for such demanding steam states have not yet been produced.

SUMMARY OF INVENTION

The object of the invention is therefore to specify a steam generator of the type mentioned above that is particularly suitable for a design with comparatively high steam parameters, in particular for live steam temperatures of up to around 700° C., whilst retaining a particularly simple structure.

According to the invention this object is achieved in that a throughflow segment connected after the first throughflow segment, viewed in the direction of flow of the hot gas, forms the first evaporator stage for the flow medium.

The invention is thereby based on the consideration that for a particularly simple structure and in particular also for a reasonably low assembly cost, even if the continuous steam generator is designed for demanding steam states of the type mentioned above, the steam generator should largely be built with recourse to previously used, comparatively easy to handle materials. As far as the material loadings that occur are concerned, the design should thereby take into account heating such that locally occurring maximum temperatures in the tube walls can be limited. It is thereby taken into account that the form of the temperature profile on the outside of the combustion chamber wall, viewed in the direction of flow of the hot gas, is a function of the balance of the heat flows to and from each point, the heat input at the internal wall of the combustion chamber resulting from the radiation of the burner flame and the dissipation primarily resulting from the heat transfer to the flow medium conducted in the respective steam generator tubes. It was acknowledged in particular that the heat input in the direction of expansion of the combustion chamber defined by the direction of flow of the hot gas is not constant but varies locally. The heat flow density occurring on the inside of the combustion chamber wall during operation of the continuous steam generator exhibits a clear maximum in roughly a central region of the combustion chamber, in which a throughflow segment provided as the second evaporator stage is generally arranged in known steam generators, such that particularly high local maximum temperatures can also be expected in the tube walls in this very region. To limit the temperatures occurring at the tube walls at this point, a comparatively cold flow medium should flow through the tubes there. This can be achieved by connecting the throughflow segments of the steam generator in an appropriate manner.

The throughflow segment connected as the first evaporator stage in this spatial region is thereby subjected in particular to the action of as yet unevaporated flow medium. A preheater is also connected directly before this throughflow segment preferably via an intake collector, such that in particular no further active components such as evaporator heating surfaces for example are connected between these.

The throughflow segment provided as the first evaporator stage advantageously comprises that region of the combustion chamber wall, where heating is at a maximum during the stationary operation of the continuous steam generator. In this region the heat input due to the radiation of the burner flame in particular has a maximum value per unit of surface and time compared with the combustion chamber wall as a whole. In the case of newly designed plants, this region can be determined by simulation calculations and in the case of old plants that are to be modified it can be determined by measurement. This allows the combustion chamber wall to be divided into throughflow segments in a manner that is particularly well suited to the form of the temperature profile in the direction of expansion of the steam generator.

The throughflow segment provided as the first evaporator stage is advantageously connected on the output side to a second evaporator stage comprising at least one further throughflow segment of the combustion chamber wall. The heat input being effected in this region of the combustion chamber wall is thus utilized in a particularly favorable manner for further heating and evaporation of the flow medium.

At least one further evaporator stage, comprising at least one evaporator heating surface arranged in an enclosing wall of the combustion chamber, is advantageously connected after the second evaporator stage on the flow medium side. This can be a further evaporator heating surface in a side wall of the combustion chamber or, in the case of a horizontal combustion chamber structure, an evaporator heating surface arranged in the top or front wall.

In a particularly advantageous embodiment the throughflow segment provided as the first evaporator stage is the throughflow segment arranged in the second position, viewed in the direction of flow of the hot gas. This allows the steam generator to have a particularly simple structure with a small number of throughflow segments and connecting lines.

The throughflow segment provided as the first evaporator stage is advantageously connected to a second evaporator stage, which comprises the throughflow segment of the combustion chamber wall arranged in the first position, viewed in the direction of flow of the hot gas. This allows particularly simple connection of the first and second evaporator stages with comparatively short lines.

In an embodiment that is particularly advantageous for a simple structure of the steam generator, the combustion chamber is designed for the main flow direction of the hot gas to be vertical. In this instance in particular it can be surrounded by an enclosing wall, which tapers in the nature of a funnel around its base. This form allows the uncomplicated removal of ash resulting during the combustion process from the funnel opening at the base.

As the burners are generally arranged above the funnel section and the hot gas heated by them flows upward, the heat input into the combustion chamber wall reaches a maximum value above the funnel section in relation to the vertical expansion of the combustion chamber. The throughflow segment provided as the first evaporator stage is therefore advantageously arranged above a funnel wall defining the funnel around the base of the combustion chamber.

Such a steam generator is preferably designed with a combustion chamber oriented for a vertical throughflow of hot gas for evaporation in three evaporator stages, with a throughflow segment comprising the funnel side wall being connected as the second evaporator stage after the throughflow segment provided as the first evaporator stage and a throughflow segment arranged above the throughflow segment provided as the first evaporator stage being connected as the third evaporator stage on the flow medium side. This means that the heat dissipated by the hot gas to the combustion chamber wall as a whole is utilized in a consistent manner and subject to particularly effective cooling of the steam generator tubes in the region of the first two evaporator stages.

Tube cooling can be further assisted by arranging the steam generator tubes of the throughflow segment provided as the first evaporator stage preferably in a spirally winding manner from bottom to top around the combustion chamber.

In an alternative advantageous embodiment the combustion chamber of the continuous steam generator is designed for the main flow direction of the hot gas to be horizontal, with one enclosing wall of the combustion chamber being the front wall, one enclosing wall being the top wall and two enclosing walls of the combustion chamber being side walls. The burners operated using fossil fuel are thereby arranged on the front face of the combustion chamber. Their flames are oriented horizontally. This embodiment allows the steam generator to have a particularly compact structure, in particular a particularly low overall height.

In this instance a second evaporator stage, having at least one further throughflow segment of the side wall and an evaporator heating surface arranged in the front wall, is advantageously connected after the throughflow segment provided as the first evaporator stage. An evaporator heating surface arranged in the top wall of the combustion chamber is thereby preferably provided as the third evaporator stage. In particular the evaporator heating surfaces of the top and front wall are connected after the first evaporator stage in the side wall, said evaporator stage being heated to a greater degree in respect of steam generation, such that comparatively low-temperature, fluid flow medium is available in the region of the first evaporator stage for particularly effective cooling of the steam generator tubes arranged there.

To improve the cooling effect, the steam generator tubes of the throughflow segment provided as the first evaporator stage advantageously have internal ribs, which favor the wetting of the internal walls of the tube with fluid flow medium due to the twist of the flow. This improves the transfer of heat from the internal wall of the tube to the flow medium. The steam generator tubes of the third evaporator stage in the top wall of the combustion chamber can be configured as smooth tubes made from a particularly heat-resistant, higher-quality material at reasonable cost.

To increase the overall efficiency of the continuous steam generator, a preheater connected before the first evaporator stage on the flow medium side is preferably arranged in a gas train connected after the combustion chamber on the hot gas side. This allows the residual heat of the hot gas flowing out from the gas train into the surrounding area to be re-used effectively.

The advantages achieved with the invention in particular comprise the fact that by specifically selecting the throughflow sequence of the throughflow segments, comparatively low-temperature flow medium can be fed to a throughflow segment connected after the first throughflow segment, viewed in the direction of flow of the hot gas, said throughflow segment being heated to a particularly significant degree, which can bring about a significant cooling effect on the steam generator tubes there. It is therefore not necessary to use particularly high-quality materials in this region of the combustion chamber, even when the steam states make high demands on the design. This is generally also true of the region(s) of the combustion chamber wall, which optionally comprise(s) a second evaporator stage connected after the first evaporator stage, as the heat input there is less than in the region of the first evaporator stage. The use of particularly high-quality, subsequently heat-treated materials may thus only be necessary in the region of even higher evaporator stages.

Tried and tested materials can thus be used reliably even with the required high steam parameters, in particular in those spatial regions where particularly effective cooling mechanisms, such as a spiral winding of the tubes or internal ribs in the tubes are required, for which the use of new, subsequently heat-treated materials may not be considered for cost reasons or for reasons of principle.

Already existing continuous steam generators of conventional structure can be upgraded by a comparatively simple modification of the throughflow sequence in the described manner for higher live steam temperatures.

BRIEF DESCRIPTION OF THE DRAWINGS

An exemplary embodiment of the invention is described in more detail below with reference to a drawing, in which.

The same parts are shown with the same reference characters in both figures.

DETAILED DESCRIPTION OF INVENTION

Figure 1:
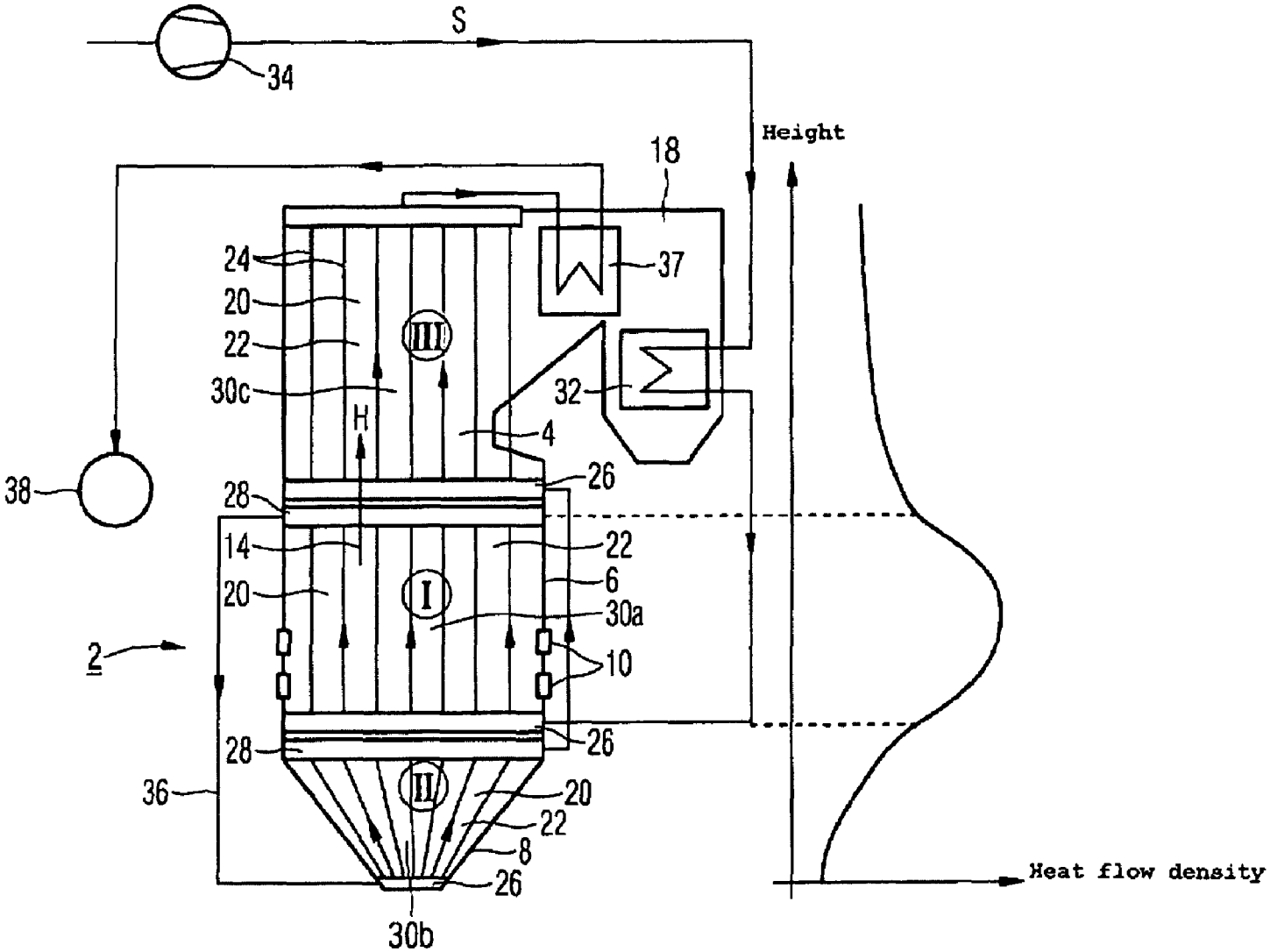
FIG. 1 shows a schematic diagram of a fossil-fuel heated continuous steam generator with a vertically oriented combustion chamber, viewed from the side

The fossil-fuel heated steam generator 2 according to the left part of FIG. 1 is conceived as a continuous steam generator with an upright structure. It comprises a combustion chamber 4 with a vertical structure, with a number of combustion chamber walls 6 forming the enclosing wall of the combustion chamber 4. Above a tapering section around the base of the combustion chamber 4 forming a funnel 8, a number of burners 10 are arranged, to which fossil fuel is fed via a fuel line. The hot gas H heated by the flames of the burner 10 flows in an approximately vertical flow direction, shown by the arrow 14, to the outlet opening arranged at the upper end of the combustion chamber 4. After flowing through the connected gas train 18, which in particular comprises a number of superheater heating surfaces 37, the hot gas H, which has in the meantime been cooled to the greatest possible degree, escapes through a chimney (not shown) into the environment. Ash-type combustion residues drop down in the combustion chamber 4 and collect around the base of the funnel 8, from whence they are removed as required.

The heat dissipated via the thermal radiation of the burner flame to the combustion chamber wall 5 of the combustion chamber 4 is used to evaporate a flow medium S flowing through the combustion chamber wall 6. To this end the combustion chamber wall 6 of the combustion chamber 4 is divided in the direction of flow of the hot gas H shown by the arrow 14 into three throughflow segments 22 formed by evaporator heating surfaces 20. A first throughflow segment 22 comprises the region of the funnel 8. Two further throughflow segments 22 are connected in the direction of flow of the hot gas H. Each of the three throughflow segments 22 is formed from steam generator tubes 24, each welded together in a gas-tight manner, which can be subjected to the action of flow medium S in a parallel manner via an intake collector 26 acting as a distributor in each instance. The heat dissipated to the combustion chamber wall 6 of the combustion chamber 4 is transferred via the internal tube walls of the steam generator tubes 24 to the flow medium S, preferably water or a water-steam mixture, resulting in its evaporation. The water-steam mixture thus generated or the steam is then collected in an outlet collector 28 connected after the respective throughflow segment 22 and supplied from there for further preparation or use.

The three throughflow segments 22 of the combustion chamber wall 6 form evaporator stages 30*a* to 30*c* connected in series on the flow medium side. This on the one hand allows the entire surface of the combustion chamber wall 6 to be used for steam generation and on the other hand the length of the steam generator tubes 24 in the respective throughflow segments 22 can be kept comparatively short, as required to produce a stable and regular flow of flow medium S.

The steam generator 2 is designed specifically for particularly efficient cooling of the steam generator tubes 24, such that the external wall temperatures occurring during operation can be kept comparatively low. To this end the throughflow sequence of the throughflow segments 22 is selected such that the central throughflow segment, viewed in the direction of flow of the hot gas H, forms the first evaporator stage 30*a* of the steam generator 2.

The first evaporator stage 30*a* is arranged specifically in a region of the combustion chamber wall 6 with maximum heat input due to radiation, as shown in the diagram illustrated in the right part of FIG. 1, showing the outward-oriented heat flow density on the inside of the combustion chamber wall 6 over the height of the combustion chamber 4. On the input side the first evaporator stage 30*a* is supplied directly by a preheater 32 arranged in the gas train 18 of the steam generator 2 and connected to the water supply pump 34 with flow medium S that is still comparatively cold and as yet has no steam element. The flow medium S, which is still comparatively cold as it enters the first evaporator stage 30*a*, can therefore ensure comparatively low wall temperatures even in the central region of the combustion chamber wall 6 with its particularly significant thermal loading.

To improve the transfer of heat, the steam generator tubes 24 of the first evaporator stage 30*a*, which run in a vertical direction, have internal ribs. In an alternative embodiment the steam generator tubes 24 of the first evaporator stage 30*a* can also be arranged in a spirally winding manner from bottom to top around the combustion chamber to ensure an adequate transfer of heat. A smooth tube design is then adequate.

On the output side the first evaporator stage 30*a* is connected via a line 36 to the second evaporator stage 30*b* in the region of the less significantly heated funnel 8. A third evaporator stage 30*c* is in turn connected after the second evaporator stage 30*b* in the upper region of the combustion chamber wall 6. The steam generator tubes 22 of the third evaporator stage 30*c* are in the form of subsequently heat-treated smooth tubes made of a comparatively high-quality material, in order to be better able to withstand the high steam temperatures there. The steam leaving the third evaporator stage 30*c* is fed for further superheating to a number of superheater heating surfaces arranged in the gas train 18 and finally made available to an external consumer 38, for example a steam turbine.

Figure 2:
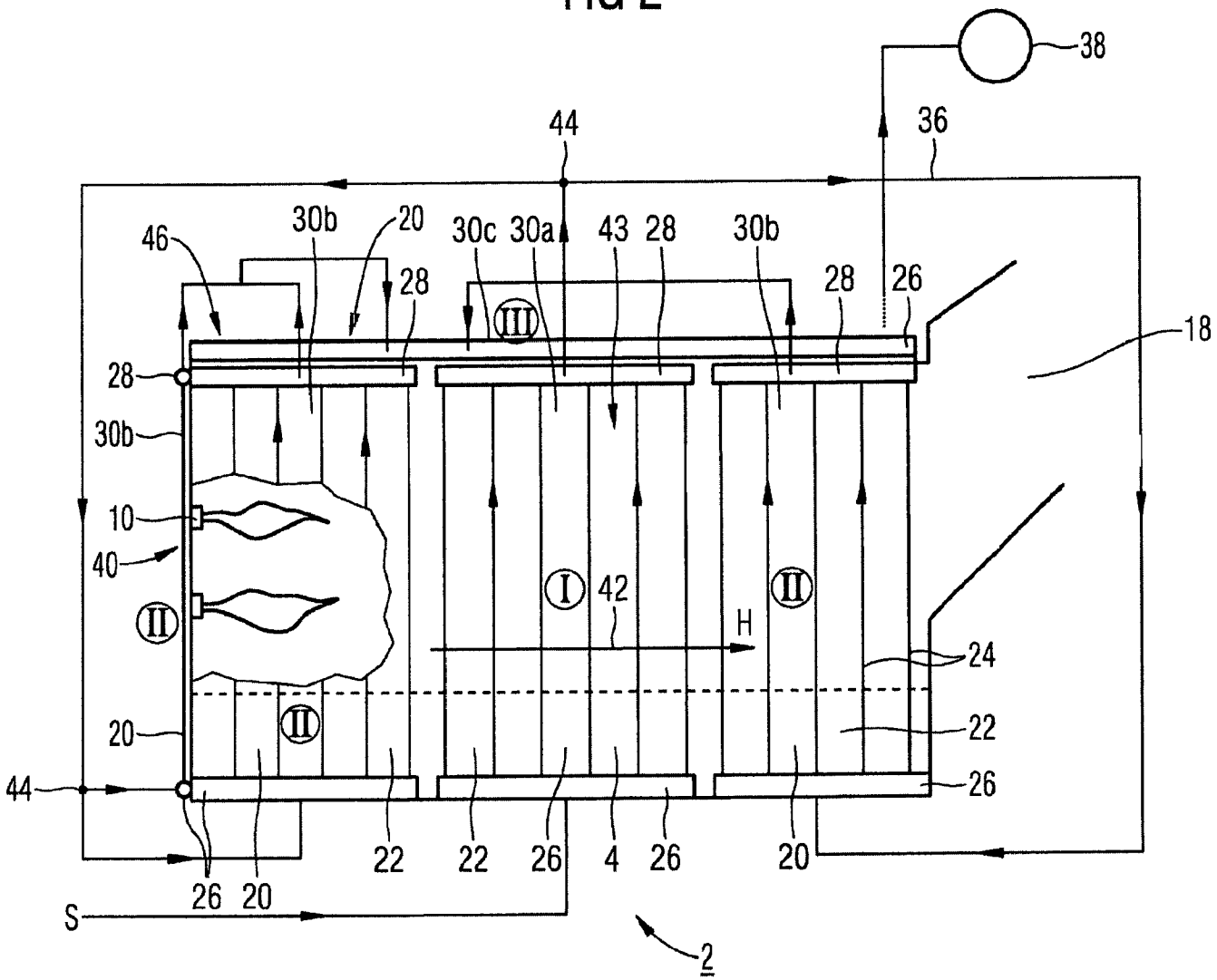
FIG. 2 shows a schematic diagram of a continuous steam generator with a horizontally oriented combustion chamber, viewed from the side.

FIG. 2 shows a schematic diagram of a partial section, viewed from the side, of a steam generator 2 with a horizontally oriented combustion chamber 4. The burners 10 arranged on the front wall 40 generate the hot gas H, which flows away in a horizontal, main flow direction, shown by the arrow 42, through the combustion chamber 4 to the gas train 18 opposite.

The two side walls 43 of the combustion chamber 4, which converge in the lower region in a funnel or trough shape, are divided in each instance into three throughflow segments 22 formed by evaporator heating surfaces 20, with the evaporator heating surfaces 20 each comprising steam generator tubes 24 that can be subjected to the action of a flow medium S from bottom to top in a parallel manner in each instance. The second throughflow segment 22, viewed in the direction of flow of the hot gas H, covering a region of the side wall 43 with a particularly high heat input, thereby forms a first evaporator stage 30*a* of the steam generator 2. The steam flowing out of the first evaporator stage on the output side or the water-steam mixture is fed via the distributor 44 to the two further throughflow segments 22, each arranged in a side wall 43 of the combustion chamber 4 and an evaporator heating surface 20 in the front wall 40, which in this manner together form a second evaporator stage 30*b* of the steam generator 2. The front evaporator heating surface 20 and the directly adjacent evaporator heating surface 20 of the first throughflow segment 22 of the side wall 43, viewed in the direction of flow of the hot gas H, can also be provided with a common intake collector 26 and a common outlet collector 28, as if considered as a single evaporator heating surface 20.

The flow medium S leaving the evaporator heating surfaces 20 of the second evaporator stage, which are connected in parallel, via individual lines 36 ultimately converges and is fed to a third evaporator stage 30*c* in the top wall 46 of the combustion chamber 4. After leaving the third evaporator stage 30*c* the steam thus generated is superheated in superheater heating surfaces (not shown in detail) in the gas train 18 and ultimately made available to an external consumer 38.

The invention claimed is:

1. A fossil-fuel heated continuous steam generator, comprising:

a combustion chamber having a combustion chamber wall that defines an interior of the chamber where a hot gas flows; and a plurality of throughflow segments formed by evaporator heating surfaces arranged in the interior of the combustion chamber parallel to a direction of flow of the hot gas, wherein the evaporator heating surfaces comprise a plurality of parallel gas tight steam generator tubes that convey a flow medium, and wherein one of the plurality of throughflow segments is associated with a first evaporator stage of the flow medium is connected after a first throughflow segment with respect to the direction of flow of the hot gas, wherein the throughflow segment associated with the first evaporator stage comprises a region of the combustion chamber wall where heating by the hot gas is a maximum during stationary operation.

2. The continuous steam generator according to claim 1, further comprising a preheater connected before the throughflow segment forming the first evaporator stage on the flow medium side via an intake collector.

3. The continuous steam generator according to claim 1, wherein the combustion chamber is oriented vertically for the direction of flow of the hot gas to be vertical.

4. The continuous steam generator according to claim 3, wherein the throughflow segment associated with the first evaporator stage is arranged above a funnel wall defining a funnel around the base of the combustion chamber.

5. The continuous steam generator according to claim 4, wherein a throughflow segment comprising the funnel wall is connected as the second evaporator stage and a throughflow segment arranged above the throughflow segment associated with the first evaporator stage is connected as the third evaporator stage after the throughflow segment associated with the first evaporator stage on the flow medium side.

6. The continuous steam generator according to claim 1, wherein the combustion chamber is designed for the main direction of flow of the hot gas to be horizontal, with the enclosing walls being a front wall, a top wall, and two side walls.

7. The continuous steam generator according to claim 6, wherein a second evaporator stage, which comprises a further throughflow segment of the side wall and an evaporator heating surface arranged in the front wall, and an evaporator heating surface arranged in the top wall of the combustion chamber are connected after the throughflow segment associated with the first evaporator stage on the flow medium side as the third evaporator stage.

8. The continuous steam generator according to claim 7, wherein the steam generator tubes of the throughflow segment associated with the first evaporator stage have internal ribs.

9. A fossil-fuel heated continuous steam generator, comprising:

a combustion chamber having a combustion chamber wall that defines an interior of the chamber where a hot gas flows; and a plurality of throughflow segments formed by evaporator heating surfaces arranged in the interior of the combustion chamber parallel to a direction of flow of the hot gas, wherein the evaporator heating surfaces comprise a plurality of parallel gas tight steam generator tubes that convey a flow medium, and wherein one of the plurality of throughflow segments is associated with a first evaporator stage of the flow medium is connected after a first throughflow segment with respect to the direction of flow of the hot gas, wherein the throughflow segment associated with the first evaporator stage is connected on the output side to a second evaporator stage that is associated with a first throughflow segment of the combustion chamber wall.

10. The continuous steam generator according to claim 9, wherein a further evaporator stage, comprising an evaporator heating surface arranged along an enclosing wall of the combustion chamber is connected after the second evaporator stage on the flow medium side.

11. A fossil-fuel heated continuous steam generator, comprising:

a combustion chamber having a combustion chamber wall that defines an interior of the chamber where a hot gas flows; and a plurality of throughflow segments formed by evaporator heating surfaces arranged in the interior of the combustion chamber parallel to a direction of flow of the hot gas, wherein the evaporator heating surfaces comprise a plurality of parallel gas tight steam generator tubes that convey a flow medium, and wherein one of the plurality of throughflow segments is associated with a first evaporator stage of the flow medium is connected after a first throughflow segment with respect to the direction of flow of the hot gas, wherein the throughflow segment associated with the first evaporator stage is the throughflow segment arranged in a second position, viewed in the direction of flow of the hot gas.

12. The continuous steam generator according to claim 11, wherein the throughflow segment associated with the first evaporator stage is connected to a second evaporator stage, that comprises the throughflow segment of the combustion chamber wall in the second position, viewed in the direction of flow of the hot gas.

13. A fossil-fuel heated continuous steam generator, comprising:

a combustion chamber having a combustion chamber wall that defines an interior of the chamber where a hot gas flows; and a plurality of throughflow segments formed by evaporator heating surfaces arranged in the interior of the combustion chamber parallel to a direction of flow of the hot gas, wherein the evaporator heating surfaces comprise a plurality of parallel gas tight steam generator tubes that convey a flow medium, and wherein one of the plurality of throughflow segments is associated with a first evaporator stage of the flow medium is connected after a first throughflow segment with respect to the direction of flow of the hot gas, comprising a preheater connected before the first evaporator stage on the flow medium side is arranged in a gas train connected after the combustion chamber on the hot gas side.

* * * * *